US008681078B2

(12) United States Patent
Sugimoto

(10) Patent No.: US 8,681,078 B2
(45) Date of Patent: Mar. 25, 2014

(54) DISPLAY UNIT, METHOD OF DRIVING THE SAME, AND ELECTRONICS DEVICE

(75) Inventor: Hideki Sugimoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 244 days.

(21) Appl. No.: 12/831,655

(22) Filed: Jul. 7, 2010

(65) Prior Publication Data

US 2011/0013099 A1 Jan. 20, 2011

(30) Foreign Application Priority Data

Jul. 14, 2009 (JP) ..... 2009-165379

(51) Int. Cl.
*G09G 3/30* (2006.01)

(52) U.S. Cl.
USPC ..... 345/78

(58) Field of Classification Search
USPC ..... 345/36, 45, 86–81, 76–83
See application file for complete search history.

(56) References Cited

U.S. PATENT DOCUMENTS

| | | | | |
|---|---|---|---|---|
| 5,262,766 | A * | 11/1993 | Sakamoto et al. | 345/691 |
| 2004/0263440 | A1* | 12/2004 | Kimura et al. | 345/76 |
| 2005/0280613 | A1* | 12/2005 | Takei et al. | 345/76 |
| 2007/0152921 | A1* | 7/2007 | Osame | 345/76 |
| 2007/0296672 | A1* | 12/2007 | Kim et al. | 345/92 |

FOREIGN PATENT DOCUMENTS

JP 2008-009391 1/2008

* cited by examiner

*Primary Examiner* — Chanh Nguyen
*Assistant Examiner* — Sanghyuk Park
(74) *Attorney, Agent, or Firm* — Dentons US LLP

(57) ABSTRACT

A display unit with which the internal structure is able to be simplified, a method of driving the same, and an electronics device are provided. The display unit includes a video signal processing circuit, a signal line drive circuit, a power source line drive circuit and a scanning line drive circuit. The power source line drive circuit concurrently applies a control pulse to the all power source lines, and concurrently controls light emission and light extinction of the all light emitting devices. The scanning line drive circuit applies a first selection pulse to the all scanning lines during time period when the fixed voltage is applied, and subsequently and sequentially applies a second selection pulse to the plurality of scanning lines during time period when the erasing pulse is applied.

4 Claims, 8 Drawing Sheets

DISPLAY UNIT, METHOD OF DRIVING THE SAME, AND ELECTRONICS DEVICE

BACKGROUND OF THE INVENTION

1. Field of the Invention

The present invention relates to a display unit that displays an image with the use of a light emitting device arranged for every pixel and a method of driving the same. The present invention further relates to an electronics device including the foregoing display unit.

2. Description of the Related Art

In recent years, in the field of display units for displaying images, display units including a current drive type optical device with the light emitting luminance changeable according to the flowing current value such as an organic EL (electro luminescence) device as a light emitting device of a pixel have been developed, and such display units are facilitated to be commercialized.

The organic EL device is a self-light emitting device differently from a liquid crystal device or the like. Thus, a display unit (organic EL display unit) including the organic EL device does not need a light source (backlight). Accordingly, in the organic EL display unit, compared to a liquid crystal display unit necessary for a light source, the image visibility is high, the electric power consumption is low, and the device response rate is high.

Drive systems in the organic EL display unit include simple (passive) matrix system and active matrix system as the drive system thereof as in the liquid crystal display unit. The former system has a disadvantage that it is difficult to realize a large and high definition display unit, though its structure is simple. Thus, currently, the active matrix system has been actively developed. In such a system, a current flowing through a light emitting device arranged for every pixel is controlled by an active deice provided in a drive circuit provided for every light emitting device (in general, TFT (Thin Film Transistor)).

SUMMARY OF THE INVENTION

In the existing organic EL display unit, scanning is performed for every one horizontal line, and $V_{th}$ correction, μ correction, signal writing and the like are sequentially performed (refer to Japanese Unexamined Patent Application Publication No. 2008-9391). Thus, a circuit for scanning a power source line provided for every one horizontal line is necessitated, and the internal structure of the organic EL display unit is complicated. Further, in performing signal writing, a DAC (Digital-Analog Converter) is necessitated, leading to the complicated internal structure of the organic EL display unit.

In view of the foregoing disadvantage, in the invention, it is desirable to provide a display unit with which the internal structure is able to be simplified, a method of driving the same, and an electronics device.

According to an embodiment of the invention, there is provided a display unit including a pixel circuit array section, a video signal processing circuit, a signal line drive circuit, a power source line drive circuit, and a scanning line drive circuit. The pixel circuit array section includes a plurality of scanning lines and a plurality of power source lines arranged in rows, a plurality of signal lines arranged in columns, and a plurality of light emitting devices and a plurality of pixel circuits arranged in a matrix state correspondingly to an intersection of each scanning line and each signal line. The video signal processing circuit sets timing of outputting an erasing pulse determining a duty ratio between light emitting period and light extinction period and a signal line to which the erasing pulse is outputted based on a video signal. The signal line drive circuit applies a fixed voltage to each signal line and writes the fixed voltage or a voltage corresponding thereto into the all pixel circuits, and subsequently outputs the erasing pulse at the timing set by the video signal processing circuit to the specific signal line. The power source line drive circuit concurrently applies a control pulse to the all power source lines, and concurrently controls light emission and light extinction of the all light emitting devices. The scanning line drive circuit applies a first selection pulse to the all scanning lines during time period when the fixed voltage is applied, and subsequently and sequentially applies a second selection pulse to the plurality of scanning lines during time period when the erasing pulse is applied.

According to an embodiment of the invention, there is provided an electronics device including the foregoing display unit.

According to an embodiment of the invention, there is provided a method of driving a display unit including the following five steps:

A. step of preparing a display unit that includes following structures;

B. step of setting timing of outputting an erasing pulse determining a duty ratio between light emitting period and light extinction period and a signal line to which the erasing pulse is outputted based on a video signal;

C. step of applying a fixed voltage to each signal line and writing the fixed voltage or a voltage corresponding thereto into the all pixel circuits, and subsequently outputting the erasing pulse at the timing set by a video signal processing circuit to the specific signal line;

D. step of concurrently applying a control pulse to the all power source lines, and concurrently controlling light emission and light extinction of the all light emitting devices; and E. step of applying a first selection pulse to the all scanning lines during time period when the fixed voltage is applied, and subsequently and sequentially applying a second selection pulse to the plurality of scanning lines during time period when the erasing pulse is applied.

The display unit for which the foregoing method of driving the same includes a pixel circuit array section and a drive circuit that drives the pixel circuit array section. The pixel circuit array section includes a plurality of scanning lines arranged in rows, a plurality of signal lines arranged in columns, and a plurality of light emitting devices and a plurality of pixel circuits arranged in a matrix state correspondingly to an intersection of each scanning line and each signal line.

In the display unit, the method of driving the same, and the electronics device of the embodiment of the invention, by applying the fixed voltage to each signal line, writing into the all pixel circuits are concurrently performed. After that, the erasing pulse is outputted at the timing based on the video signal to the specific signal line. Thereby, it is not necessary to perform signal writing by scanning for every one horizontal line, and thus a circuit for scanning the power source line provided for every one horizontal line is not necessitated. Further, it is not necessary to use a DAC in performing signal writing.

According to the display unit, the method of driving the same, and the electronics device of the embodiment of the invention, it is not necessary to use a circuit for scanning the power source line provided for every one horizontal line and the DAC in performing signal writing. Thereby, the internal structure of the display unit is able to be simplified.

Other and further objects, features and advantages of the invention will appear more fully from the following description.

DETAILED DESCRIPTION OF THE PREFERRED EMBODIMENT

An embodiment of the invention will be hereinafter described in detail with reference to the drawings. The description will be given in the following order:

1. Embodiment
1.1 Schematic structure of display unit
1.2. Operation of display unit
1.3. Action and effect
2. Module and application examples

1. Embodiment 1.1 Schematic Structure of Display Unit

Figure 1:
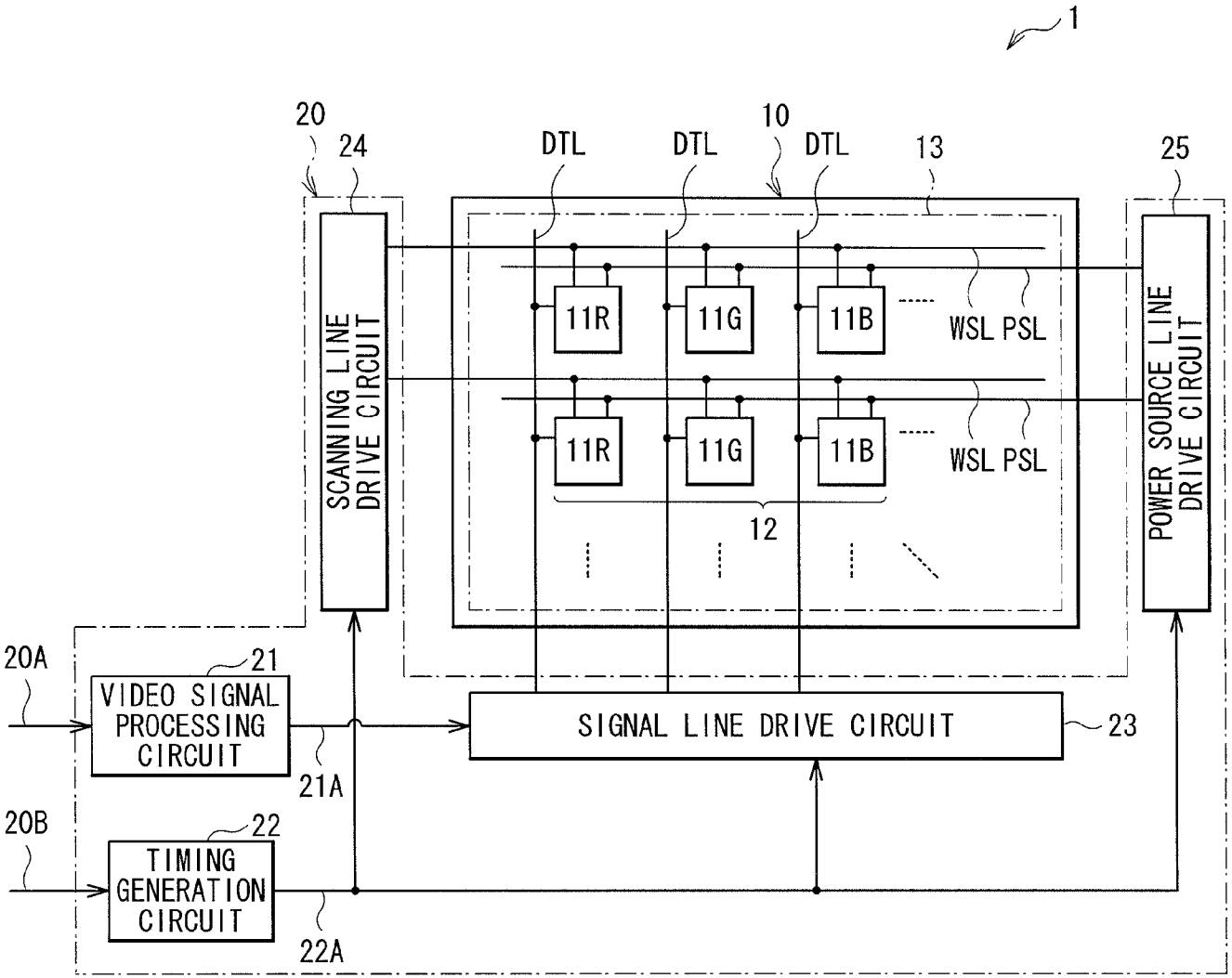
FIG. 1 is a structural view illustrating an example of a display unit according to an embodiment of the invention.

FIG. 1 illustrates a schematic structure of a display unit 1 according to an embodiment of the invention. The display unit 1 includes a display panel 10 and a drive circuit 20. The display panel 10 has a pixel circuit array section 13 in which, for example, a plurality of organic EL devices 11R, 11G, and 11B (light emitting device) are arranged in a matrix state. In this embodiment, for example, a combination of three organic EL devices 11R, 11G, and 11B adjacent to each other composes one pixel 12. In the following description, as a generic term of the organic EL devices 11R, 11G, and 11B, an organic EL device 11 is used as appropriate. The drive circuit 20 drives the pixel circuit array section 13, and, for example, has a video signal processing circuit 21, a timing generation circuit 22, a signal line drive circuit 23, a scanning line drive circuit 24, and a power source line drive circuit 25.

Pixel Circuit Array Section

Figure 2:
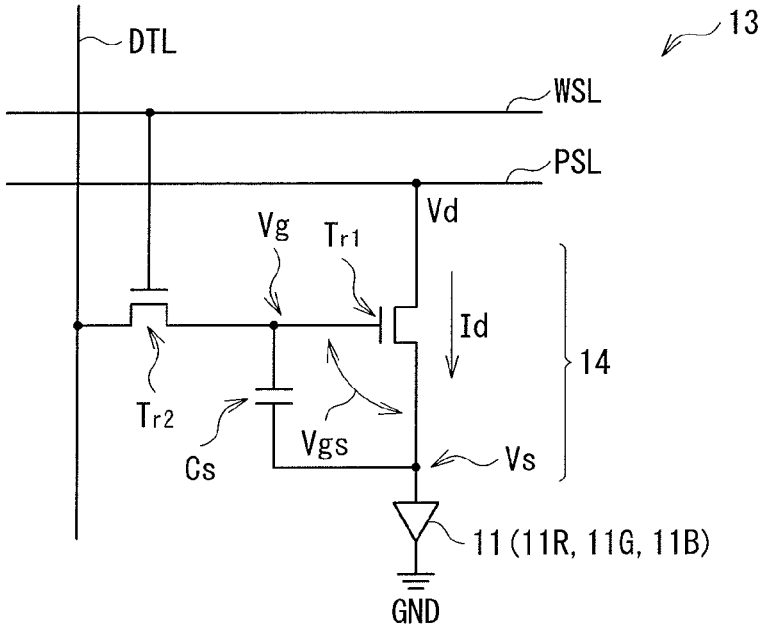
FIG. 2 is a structural view illustrating an example of an internal structure of the pixel circuit array section of FIG. 1.

FIG. 2 illustrates an example of a circuit structure of the pixel circuit array section 13. The pixel circuit array section 13 is formed in a display region of the display panel 10. For example, as illustrated in FIG. 1 and FIG. 2, the pixel circuit array section 13 has a plurality of scanning lines WSL arranged in rows, a plurality of signal lines DTL arranged in columns, and a plurality of power source lines PSL arranged in rows along the scanning lines WSL. The plurality of organic EL devices 11 and pixel circuits 14 are arranged in a matrix state (two dimensional arrangement) correspondingly to an intersection of each scanning line WSL and each signal line DTL. The pixel circuit 14 is composed of, for example, a drive transistor $T_{r1}$, a writing transistor $T_{r2}$, and a retentive capacity $C_s$, and has a circuit structure of 2Tr1C. The drive transistor $T_{r1}$ and the writing transistor $T_{r2}$ are formed from, for example, an n channel MOS type thin film transistor (TFT (Thin Film Transistor)). The TFT type is not particularly limited, and may be, for example, inversely staggered structure (so-called bottom gate type) or staggered structure (top gate type). Further, the drive transistor $T_{r1}$ or the writing transistor $T_{r2}$ may be a p channel MOS type TFT.

In the pixel circuit array section 13, each signal line DTL is connected to an output terminal (not illustrated) of the signal line drive circuit 23 and a drain electrode (not illustrated) of the writing transistor $T_{r2}$. Each scanning line WSL is connected to an output terminal (not illustrated) of the scanning line drive circuit 24 and a gate electrode (not illustrated) of the writing transistor $T_{r2}$. Each power source line PSL is connected to an output terminal (not illustrated) of the power source line drive circuit 25 and a drain electrode (not illustrated) of the drive transistor $T_{r1}$. A source electrode (not illustrated) of the writing transistor $T_{r2}$ is connected to a gate electrode (not illustrated) of the drive transistor $T_{r1}$ and one end of the retentive capacity $C_s$. A source electrode (not illustrated) of the drive transistor $T_{r1}$ and the other end of the retentive capacity $C_s$ are connected to an anode electrode (not illustrated) of the organic EL device 11. A cathode electrode (not illustrated) of the organic EL device 11 is connected to, for example, a ground line GND. The cathode electrode is used as a common electrode of each organic EL device 11, for example, is formed continuously over the entire display region of the display panel 10, and is in a state of a flat plate.

Drive Circuit

Next, a description will be given of each circuit in the drive circuit 20 provided around the pixel circuit array section 13 with reference to FIG. 1.

The video signal processing circuit 21 is intended to perform a specified correction of a digital video signal 20A inputted from outside, and determine a duty ratio between light emitting period and light extinction period (light emitting period/1 field period*100). Specifically, the video signal processing circuit 21 is intended to set timing of outputting erasing pulse (described later) determining the duty ratio and the signal line DTL to which the erasing pulse is outputted based on the corrected video signal. The video signal processing circuit 21 may be intended to set the timing of outputting the erasing pulse and the signal line DTL to which the erasing pulse is outputted based on the digital video signal 20A inputted from outside (that is, the video signal before correction). The video signal processing circuit 21 is, for example, intended to output an erasing control signal 21A indicating the determined timing and the signal line DTL to which the erasing pulse is outputted to the signal line drive circuit 23. That is, in this embodiment, the drive circuit 20 is intended to perform a kind of PWM (Pulse Width Modulation) drive.

Examples of correction of the digital video signal 20A include gamma correction and overdrive correction. For the timing of outputting the erasing pulse (described later), a detailed description will be given later.

The timing generation circuit 22 is intended to execute control so that the video signal processing circuit 21, the signal line drive circuit 23, the scanning line drive circuit 24, and the power source line drive circuit 25 are operated in conjunction with each other. The timing generation circuit 22 is intended to output a control signal 22A to the foregoing respective circuits according to (in sync with), for example, a synchronization signal 20B inputted from outside.

The signal line drive circuit 23 is intended to apply a certain value analog video signal that is previously set to each signal line DTL according to (in sync with) input of the control signal 22A, and to write the analog video signal or a signal corresponding thereto into the pixel circuit 14 as a selection target. Specifically, the signal line drive circuit 23 is intended to apply a voltage $V_{ofs2}$ (fixed voltage) having a constant (fixed) height value without relation to the size of the digital video signal 20A inputted from outside to each signal line DTL, and to write the voltage $V_{ofs2}$ or a voltage corresponding thereto into the all organic EL devices 11. Further, the signal line drive circuit 23 selects a signal line DTL to which the erasing pulse of a voltage $V_{ers}$ is applied and a relevant erasing selection period $T_{ers}$ out of the plurality of signal lines DTL and a plurality of erasing selection period $T_{ers}$ according to the erasing signal 21A inputted from the video signal processing circuit 21, and outputs the erasing pulse of the voltage $V_{ers}$ at the given timing (during the selected erasing selection period $T_{ers}$) to the selected signal line DTL (specific signal line DTL). Further, the signal line drive circuit 23 outputs a voltage $V_{ofs1}$ to the signal lines DTL to which the erasing pulse of the voltage $V_{ers}$ is not applied during relevant erasing selection periods $T_{ers}$ out of the plurality of signal lines DTL and the plurality of erasing selection period $T_{ers}$ according to the erasing control signal 21A inputted from the video signal processing circuit 21.

The signal line drive circuit 23 is able to output, for example, the voltage $V_{ofs1}$ and the voltage $V_{ers}$ applied to the gate of the drive transistor $Tr_1$ at the time of light extinction of the organic EL device 11, and output the voltage $V_{ofs2}$ applied to the gate of the drive transistor $Tr_1$ at the time of writing of the organic EL device 11. That is, the signal line drive circuit 23 outputs only a predetermined plurality types of (in this case, three types of) voltages. Thus, in this embodiment, the signal line drive circuit 23 does not need a DAC (Digital-Analog Converter), and has a constant voltage source outputting, for example, three types of voltages (the voltage $V_{ofs1}$, the voltage $V_{ofs2}$, and the voltage $V_{ers}$) instead of the DAC.

The value of the voltage $V_{ofs2}$ is higher than that of the voltage $V_{ofs1}$. The value of the voltage $V_{ofs1}$ is lower than that of a threshold voltage $V_{e1}$ of the organic EL device 11 (constant value), and higher than that of $V_M-V_{th\ ws}$. The value of the voltage $V_{ers}$ is higher than that of $V_L-V_{th\ ws}$, and lower than that of $V_M-V_{th\ ws}$ (constant value).

The voltage $V_M$ is a voltage (constant value) applied to the scanning line WSL in the case where erasing is selected by the video signal processing circuit 21 during the after-mentioned erasing selection period $T_{ers}$. The value of the voltage $V_M$ is higher than the voltage $V_L$ and lower than a voltage $V_H$ (constant value). More specifically, the value of the voltage $V_M$ is higher than $V_{ers}+V_{th\ ws}$ and lower than $V_{ofs}+V_{th\ ws}$ (constant value). $V_{th\ ws}$ is a threshold voltage of the writing transistor $Tr_2$. The voltage $V_{ers}$ is applied to the signal line DTL in the case where erasing is selected by the video signal processing circuit 21 during the after-mentioned erasing selection period $T_{ers}$. The value of the voltage $V_L$ is lower than that of an ON voltage of the writing transistor $Tr_2$ (constant value). The value of the voltage $V_H$ is equal to or higher than that of the ON voltage of the writing transistor $Tr_2$ (constant value). The voltage $V_{th}$ is a threshold voltage of the drive transistor $Tr_1$.

Operation of the scanning line drive circuit 24 during the erasing selection period $T_{ers}$ is different from that of the scanning line drive circuit 24 during the other time period. Specifically, during the erasing selection period $T_{ers}$, the scanning line drive circuit 24 sequentially applies a selection pulse (second selection pulse) to the plurality of scanning lines WSL according to (in sync with) input of the control signal 22A, and selects the plurality of organic EL devices 11 and the plurality of pixel circuits 14 for every one horizontal line. The scanning line drive circuit 24 applies the foregoing selection pulse during the time period when the erasing pulse is applied. Further, during the time period other than the erasing selection period $T_{ers}$, the scanning line drive circuit 24 concurrently applies a selection pulse (first selection pulse) to the all scanning lines WSL according to (in sync with) input of the control signal 22A, and concurrently selects the all organic EL devices 11 and the all pixel circuits 14. The scanning line drive circuit 24 applies the foregoing selection pulse during the time period when the voltage $V_{ofs2}$ is applied.

During the erasing selection period $T_{ers}$, the scanning line drive circuit 24 outputs the voltage $V_M$ to the scanning line WSL at the time of selection, and outputs the voltage $V_L$ to the scanning line WSL at the time of non-selection. Further, during the time period other than the erasing selection period $T_{ers}$, the scanning line drive circuit 24 outputs the voltage $V_H$ to the scanning line WSL at the time of selection, and outputs the voltage $V_L$ to the scanning line WSL at the time of non-selection. For example, the scanning line drive circuit 24 is able to output the voltage $V_H$ applied in the case where the writing transistor $Tr_2$ is turned on, the voltage $V_M$ applied in the case where whether the writing transistor $Tr_2$ is turned on or off is selected, and the voltage $V_L$ applied in the case where the writing transistor $Tr_2$ is turned off.

The power source line drive circuit 25 is intended to concurrently apply a control pulse to the all power source lines PSL according to (in sync with) input of the control signal 22A, and concurrently controls light emission and light extinction of the all organic EL devices 11. For example, the power source line drive circuit 25 is able to output a voltage $V_{ccH}$ applied in the case where a current is flown to the drive transistor $Tr_1$ and a voltage $V_{ccL}$ applied in the case where a current is not flown to the drive transistor $Tr_1$. The value of the voltage $V_{ccL}$ is lower than that of a voltage obtained by adding the threshold voltage $V_{e1}$ of the organic EL device 11 to a voltage $V_{ca}$ of the cathode of the organic EL device 11 ($V_{e1}+V_{ca}$) (constant value). The value of the voltage $V_{ccH}$ is equal to or higher than that of a voltage ($V_{e1}+V_{ca}$) (constant value).

1.2. Operation of Display Unit

Figure 3:
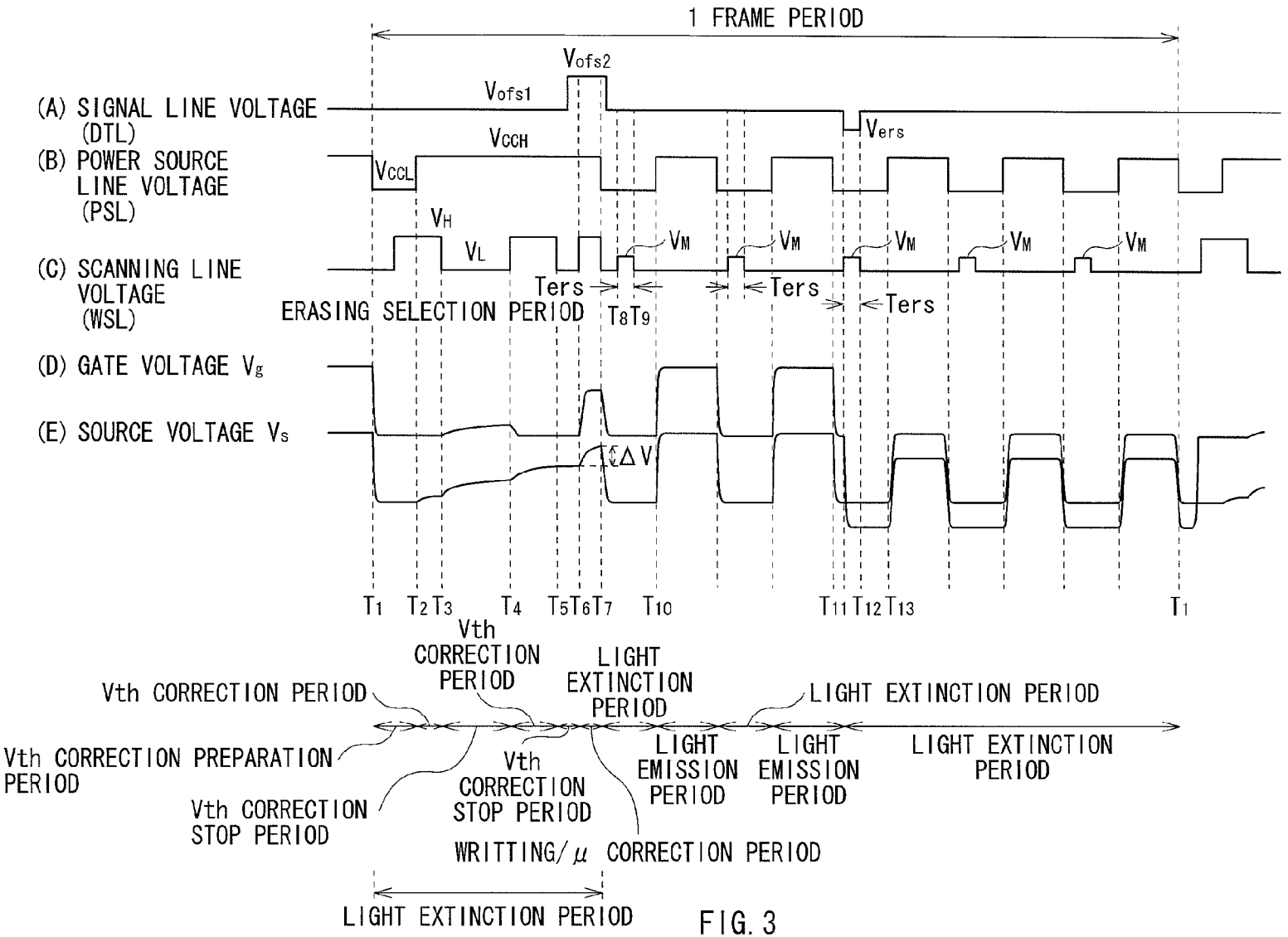
FIG. 3 is waveform chart for explaining an example of operation of one field of the display unit of FIG. 1.

FIG. 3 illustrates an example of various waveforms in the case where the display unit 1 is driven. Part A to part C in FIG. 3 illustrate a state in which $V_{ofs1}$, $V_{ofs2}$, and $V_{ers}$ are applied to the signal line DTL at the given timing, $V_H$, $V_L$, and $V_M$ are applied to the scanning line WSL at the given timing, and $V_{ccL}$ and $V_{ccH}$ are applied to the power source line PSL at the given timing. Part D and part E in FIG. 3 illustrate state in which a gate voltage $V_g$ and a source voltage $V_s$ of the drive transistor $Tr_1$ are ever-changed according to applying a voltage to the signal line DTL, the scanning line WSL, and the power source line PSL.

$V_{th}$ Correction Preparation Period

First, $V_{th}$ correction preparation is performed. Specifically, the power source line drive circuit 25 decreases the voltage of the power source line PSL from $V_{ccH}$ to $V_{ccL}$ ($T_1$). Accordingly, the source voltage $V_s$ becomes $V_{ccL}$, the organic EL device 11 is extinct, and the gate voltage $V_g$ is decreased down to $V_{ofs1}$. Next, while the voltage of the signal line DTL is $V_{ofs1}$ and the voltage of the power source line PSL is $V_{ccL}$, the scanning line drive circuit 24 increases the voltage of the scanning line WSL from $V_L$ to $V_H$.

First $V_{th}$ Correction Period

Next, $V_{th}$ correction is performed. Specifically, while the voltage of the signal line DTL is $V_{ofs1}$, the power source line drive circuit 25 increases the voltage of the power source line PSL from $V_{ccL}$ to $V_{ccH}$ ($T_2$). Accordingly, a current $I_d$ is flown between the drain and the source of the drive transistor $Tr_1$, and the source voltage $V_s$ is increased. After that, before the signal line drive circuit 23 changes the voltage of the signal line DTL from $V_{ofs1}$ to $V_{ofs2}$, the scanning line drive circuit 24 decreases the voltage of the scanning line WSL from $V_H$ to $V_L$ ($T_3$). Accordingly, the gate of the drive transistor $Tr_1$ becomes floating, and $V_{th}$ correction is stopped at once.

First $V_{th}$ Correction Stop Period

While $V_{th}$ correction is stopped, in a row (pixel) different from the row (pixel) provided with the precedent $V_{th}$ correction, sampling of the voltage of the signal line DTL is performed. In the case where $V_{th}$ correction is insufficient, that is, in the case where an electric potential difference $V_{gs}$ between the gate and the source of the drive transistor $Tr_1$ is larger than the threshold voltage $V_{th}$ of the drive transistor $Tr_1$, it results in as follows. That is, even in the $V_{th}$ correction stop period, in the row (pixel) provided with the precedent $V_{th}$ correction, a current $I_{ds}$ is flown between the drain and the source of the drive transistor $Tr_1$, the source voltage $V_s$ is increased, and the gate voltage $V_g$ is also increased due to coupling through the retentive capacity $C_s$.

Second $V_{th}$ Correction Period

After the $V_{th}$ correction stop period is finished, $V_{th}$ correction is performed again. Specifically, while the voltage of the signal line DTL is $V_{ofs1}$ and $V_{th}$ correction is available, the scanning line drive circuit 24 increases the voltage of the scanning line WSL from $V_L$ to $V_H$ ($T_4$), and connects the gate of the drive transistor $Tr_1$ to the signal line DTL. At this time, in the case where the source voltage $V_s$ is lower than ($V_{ofs1}-V_{th}$) (in the case where $V_{th}$ correction is not completed yet), the current $I_d$ is flown between the drain and the source of the drive transistor $Tr_1$ until the drive transistor $Tr_1$ is cut off (until the electric potential difference $V_{gs}$ becomes $V_{th}$). In the result, the retentive capacity $C_s$ is charged with $V_{th}$, and the electric potential difference $V_{gs}$ becomes $V_{th}$. After that, before the signal line drive circuit 23 changes the voltage of the signal line DTL from $V_{ofs1}$ to $V_{ofs2}$, the scanning line drive circuit 24 decreases the voltage of the scanning line WSL from $V_H$ to $V_L$ ($T_5$). Accordingly, the gate of the drive transistor $Tr_1$ becomes floating, and thus the electric potential difference $V_{gs}$ is kept at $V_{th}$ without relation to the voltage size of the signal line DTL. As described above, by setting the electric potential difference $V_{gs}$ to $V_{th}$, even if the threshold voltage $V_{th}$ of the drive transistor $Tr_1$ varies according to each pixel circuit 14, variation of the light emitting luminance of the organic EL device 11 is able to be prevented.

Second $V_{th}$ Correction Stop Period

After that, while $V_{th}$ correction is stopped, the signal line drive circuit 23 changes the voltage of the signal line DTL from $V_{ofs1}$ $V_{ofs2}$.

Writing and μ Correction Period

After the $V_{th}$ correction stop period is finished, writing and μ correction are performed. Specifically, while the voltage of the signal line DTL is $V_{ofs2}$, the scanning line drive circuit 24 increases the voltage of the scanning line WSL from $V_L$ to $V_H$ ($T_6$), and connects the gate of the drive transistor $Tr_1$ to the signal line DTL. Accordingly, the gate voltage of the drive transistor $Tr_1$ becomes $V_{ofs2}$. At this time, an anode voltage of the organic EL device 11 is smaller than the threshold voltage $V_{e1}$ of the organic EL device 11 yet in this stage, and the organic EL device 11 is cut off. Thus, a current $I_s$ is flown to a device capacity (not illustrated) of the organic EL device 11, and the device capacity is charged. Thus, the source voltage $V_s$ is increased by ΔV, and the electric potential difference $V_{gs}$ becomes $V_{ofs2}+V_{th}-\Delta V$. As described above, μ correction is performed concurrently with writing. As mobility μ of the drive transistor $Tr_1$ is larger, ΔV becomes larger. Thus, by decreasing the electric potential difference $V_{gs}$ by ΔV before light emission, variation of the mobility μ for every pixel circuit 14 is able to be removed.

First Light Extinction Period

Next, in the precedent writing and μ correction period, immediately before the organic EL device 11 starts light emission, at the moment of starting light emission, or immediately after the organic EL device 11 starts light emission, the power source line drive circuit 25 decreases the voltage of the power source line PSL from $V_{ccH}$ to $V_{ccL}$ ($T_7$). Accordingly, the source voltage $V_s$ is decreased down to $V_{ccL}$, the organic EL device 11 does not emit light, or light emission of the organic EL device 11 is instantly stopped.

First Erasing Selection Period $T_{ers}$

Next, during the foregoing light extinction period, the scanning line drive circuit 24 increases the voltage of the scanning line WSL from $V_L$ to $V_M$ ($T_8$). At this time, in the case where the voltage $V_{ofs1}$ is applied to the signal line DTL, the voltage $V_{gs}$ between the gate and the source of the writing transistor $Tr_2$ is $V_M-V_{ofs1}$, and is smaller than the threshold voltage $V_{th\ ws}$ of the writing transistor $Tr_2$. Thus, the writing transistor $Tr_2$ is kept cut off, and the gate of the drive transistor $Tr_1$ is kept in the floating state. Thus, the organic EL device 11 is continuously extinct without changing the gate voltage $V_g$ and the source voltage $V_s$ of the drive transistor $Tr_1$. After that, the scanning line drive circuit 24 decreases the voltage of the scanning line WSL from $V_M$ to $V_L$, and the first erasing selection period $T_{ers}$ is finished ($T_9$).

First Light Emitting Period

Next, after a given light extinction period of the organic EL device 11 elapses, the power source line drive circuit 25 increases the voltage of the power source line PSL from $V_{ccL}$ to $V_{ccH}$ ($T_{10}$). Accordingly, the current $I_d$ is flown between the drain and the source of the drive transistor $Tr_1$ in a state that the voltage $V_{gs}$ between the gate and the source of the drive transistor $Tr_1$ is maintained constantly. In the result, the source voltage $V_s$ is increased, the gate voltage $V_g$ of the drive transistor $Tr_1$ is also increased in conjunction therewith, and boot strap is generated. In the case where the voltage $V_{ofs1}$ is applied to the signal line DTL during the precedent erasing selection period $T_{ers}$ (that is, in the case where erasing is not selected), the organic EL device 11 emits light at desired luminance.

Repetition

In the case where the voltage $V_{ofs1}$ is applied to the signal line DTL during the subsequent repeated erasing selection period $T_{ers}$ (that is, in the case where erasing is not selected), the foregoing operation is repeated. That is, light emission of the organic EL device 11 and erasing are repeated, the total light emitting time during one frame period becomes longer, and the duty ratio between the light emitting period and the light extinction period (light emitting period/1 field period*100) becomes larger.

Erasing Selection Period in a Certain Turn ($T_{ers}$)

If the signal line drive circuit 23 applies the erasing pulse of the voltage $V_{ers}$ to the signal line DTL during the time when the scanning line drive circuit 24 increases the voltage of the scanning line WSL from $V_L$ to $V_M$ resulting in the erasing selection period ($T_{ers}$) ($T_{11}$), the gate voltage $V_g$ of the drive transistor $Tr_1$ is decreased down to $V_{ers}$, the source voltage $V_s$ of the drive transistor $Tr_1$ is decreased down to $V_{ccL}$, and thus the voltage $V_{gs}$ between the gate and the source of the drive transistor $Tr_1$ becomes $V_{ers}-V_{ccL}<V_{th}$. In the result, the organic EL device 11 stops light emission.

After that, even if the scanning line drive circuit 24 decreases the voltage of the scanning line WSL from $V_M$ to $V_L$ ($T_{12}$) to finish the erasing selection period and subsequently the power source line drive circuit 25 increases the voltage of the power source line PSL from $V_{ccL}$ to $V_{ccH}$ ($T_{13}$), the voltage $V_{gs}$ between the gate and the source of the transistor $Tr_1$ is kept smaller than $V_{th}$, and light emission of the organic EL device 11 is continuously stopped. As described above, in this embodiment, in the case where the voltage $V_{ers}$ is applied to the signal line DTL during the erasing selection period $T_{ers}$ (that is, in the case where erasing is selected), light emission of the organic EL device 11 is continuously stopped, the total light extinction time in one frame period becomes longer, and the duty ratio between the light emitting period and the light extinction period (light emitting period/1 field period*100) becomes smaller.

In the display unit 1 of this embodiment, as described above, the pixel circuit 14 is on/off controlled in each pixel 12, and a drive current is injected into the organic EL device 11 of each pixel 12. Thereby, electron hole recombination is generated, leading to light emission. The light is multiply reflected between the anode and the cathode, is transmitted through the cathode or the like, and extracted outside. In the result, an image is displayed on the display panel 10.

1.3 Action and Effect

In the existing organic EL display unit, scanning is performed for every one horizontal line, and $V_{th}$ correction, μ correction, signal writing and the like are sequentially performed. Thus, a power source line is necessitated for every one horizontal line, and the internal structure of the organic EL display unit is complicated.

Figure 4:
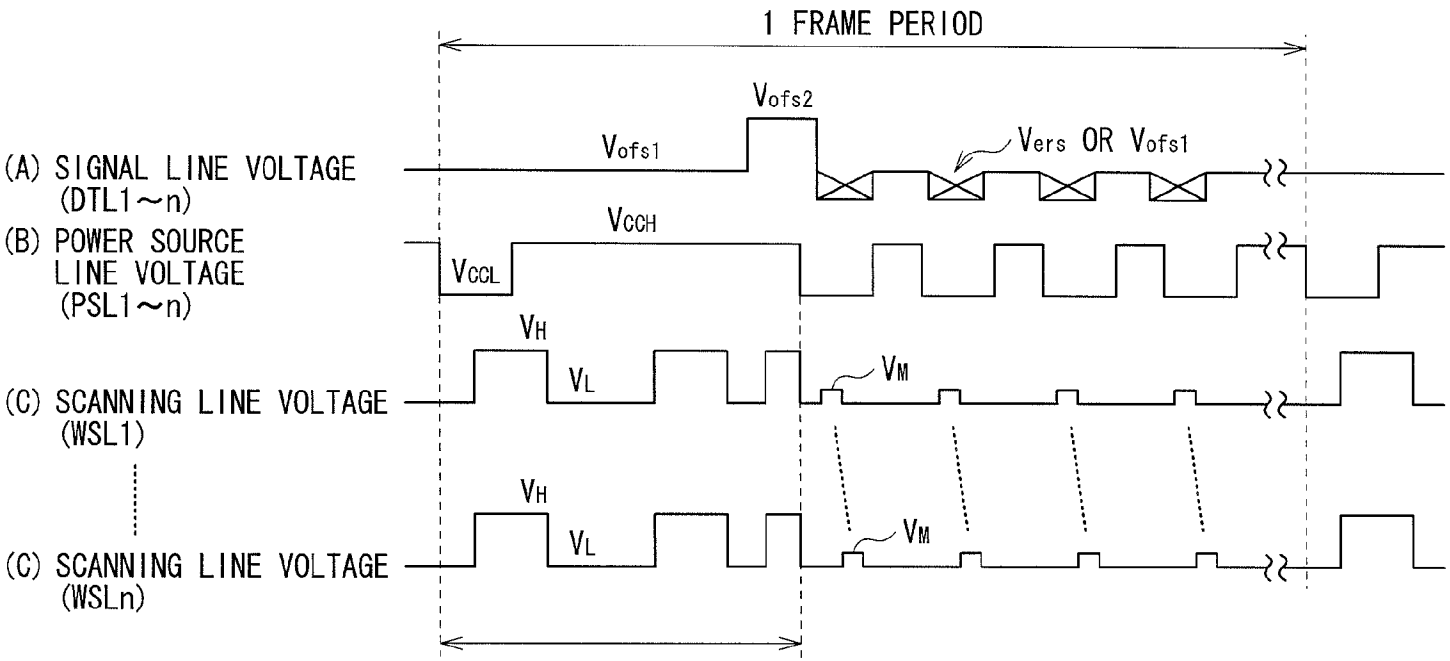
FIG. 4 is waveform chart for explaining an example of operation of one frame of the display unit of FIG. 1.

Meanwhile, in this embodiment, as illustrated in FIG. 4, $V_{th}$ correction, μ correction, and writing are executed in block for the all pixels 12 during the initial period of one frame period. After that, erasing operation to determine the duty ratio between the light emitting period and the light extinction period is executed for every one horizontal line. At this time, in the power source line drive circuit 25, the same voltages (voltages $V_{ccL}$ and $V_{ccH}$) are concurrently applied to each power source line PSL. Thus, a circuit for scanning the power source line PSL provided for one horizontal line is not necessitated, and the internal structure of an organic EL display unit is able to be simplified. Further, since writing is executed in block for the all pixels 12, in the signal line drive circuit 23, only a plurality of types of voltages that are previously set are able to be applied to the signal line DTL. In the result, the signal line drive circuit 23 is able to be structured by a constant voltage source, and a DAC is able to be eliminated from the signal line drive circuit 23. Accordingly, in this embodiment, compared to the existing organic EL display unit in which $V_{th}$ correction, μ correction, signal writing and the like are sequentially executed by scanning for every one horizontal line, the internal structure of the display unit 1 is able to be simplified.

Module and Application Examples

A description will be given of application examples of the display unit described in the foregoing embodiment. The display unit of the foregoing embodiment is able to be applied to a display unit of electronics devices in any field for displaying a video signal inputted from outside or a video signal generated inside as an image or a video such as a television device, a digital camera, a notebook personal computer, a portable terminal device such as a mobile phone, and a video camera.

Module

Figure 5:
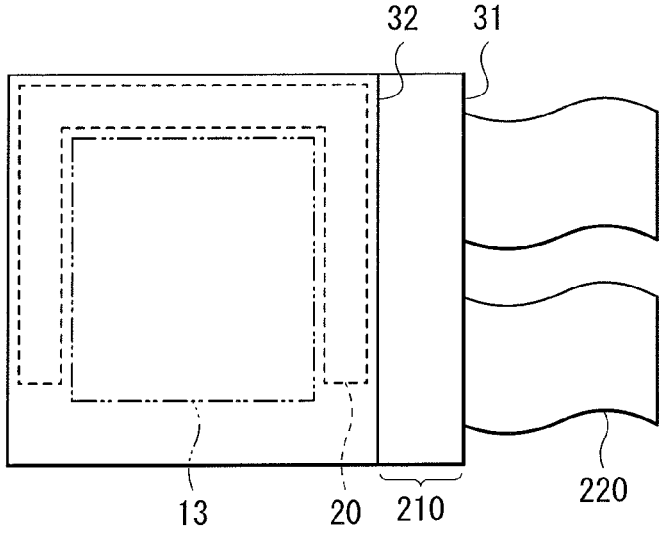
FIG. 5 is a plan view illustrating a schematic structure of a module including the display unit of the foregoing embodiment.

The display unit 1 of the foregoing embodiment is incorporated in various electronic devices such as after-mentioned first to fifth application examples as a module as illustrated in FIG. 5, for example. In the module, for example, a region 210 exposed from a sealing substrate 32 is provided in a side of a substrate 31, and an external connection terminal (not illustrated) is formed in the exposed region 210 by extending wirings of the drive circuit 20. The external connection terminal may be provided with a Flexible Printed Circuit (FPC) 220 for inputting and outputting a signal.

First Application Example

Figure 6:
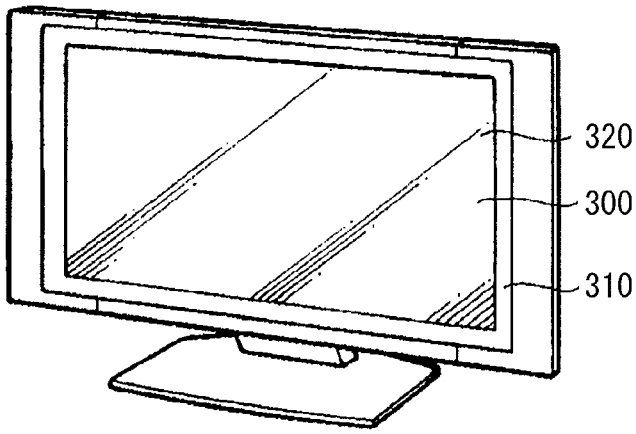
FIG. 6 is a perspective view illustrating an appearance of a first application example of the display unit of the foregoing embodiment.

FIG. 6 illustrates an appearance of a television device to which the display unit 1 of the foregoing embodiment is applied. The television device has, for example, a video display screen section 300 including a front panel 310 and a filter glass 320. The video display screen section 300 is composed of the display unit 1 of the foregoing embodiment.

Second Application Example

Figure 7A:
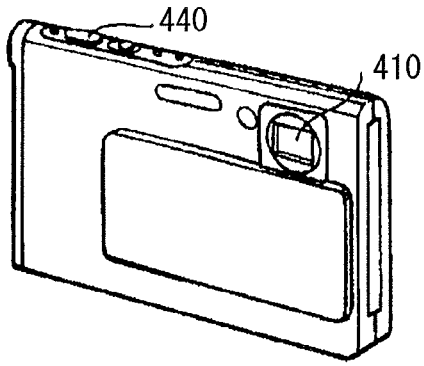
FIG. 7A is a perspective view illustrating an appearance viewed from the front side of a second application example.
Figure 7B:
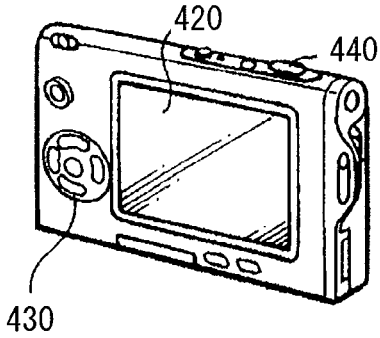
FIG. 7B is a perspective view illustrating an appearance viewed from the rear side of the second application example.

FIGS. 7A and 7B illustrate an appearance of a digital camera to which the display unit 1 of the foregoing embodiment is applied. The digital camera has, for example, a light emitting section for a flash 410, a display section 420, a menu switch 430, and a shutter button 440. The display section 420 is composed of the display unit 1 according to the foregoing embodiment.

Third Application Example

Figure 8:
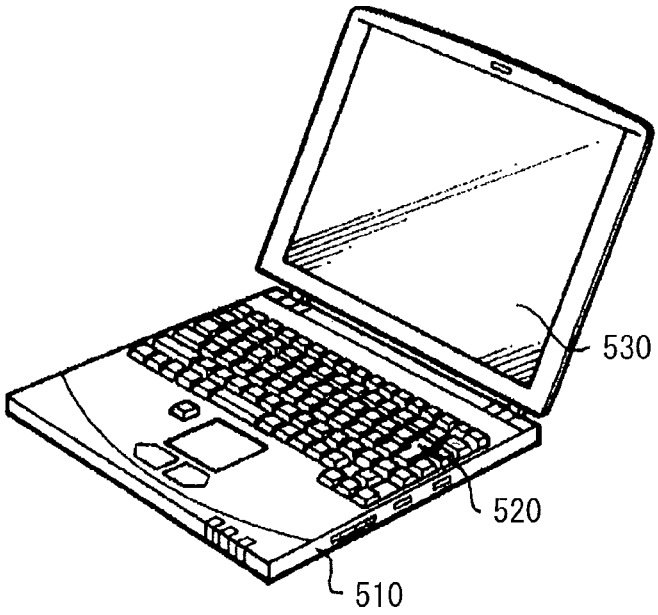
FIG. 8 is a perspective view illustrating an appearance of a third application example.

FIG. 8 illustrates an appearance of a notebook personal computer to which the display unit 1 of the foregoing embodiment is applied. The notebook personal computer has, for example, a main body 510, a keyboard 520 for operation of inputting characters and the like, and a display section 530 for displaying an image. The display section 530 is composed of the display unit 1 according to the foregoing embodiment.

Fourth Application Example

Figure 9:
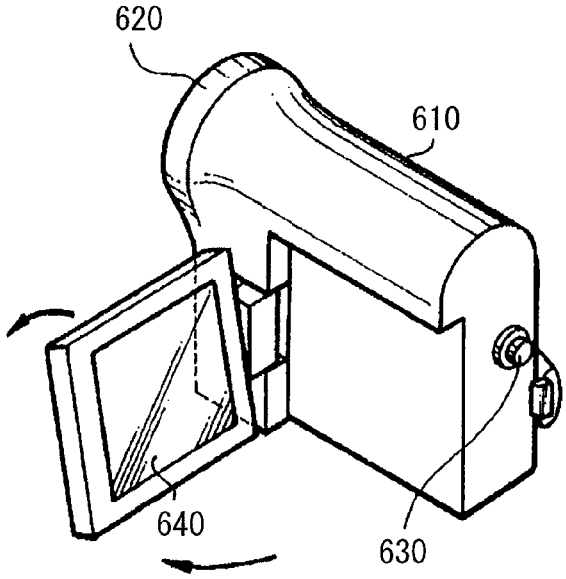
FIG. 9 is a perspective view illustrating an appearance of a fourth application example.
Figures 10A, 10B, 10C, 10D, 10E, 10F, 10G:
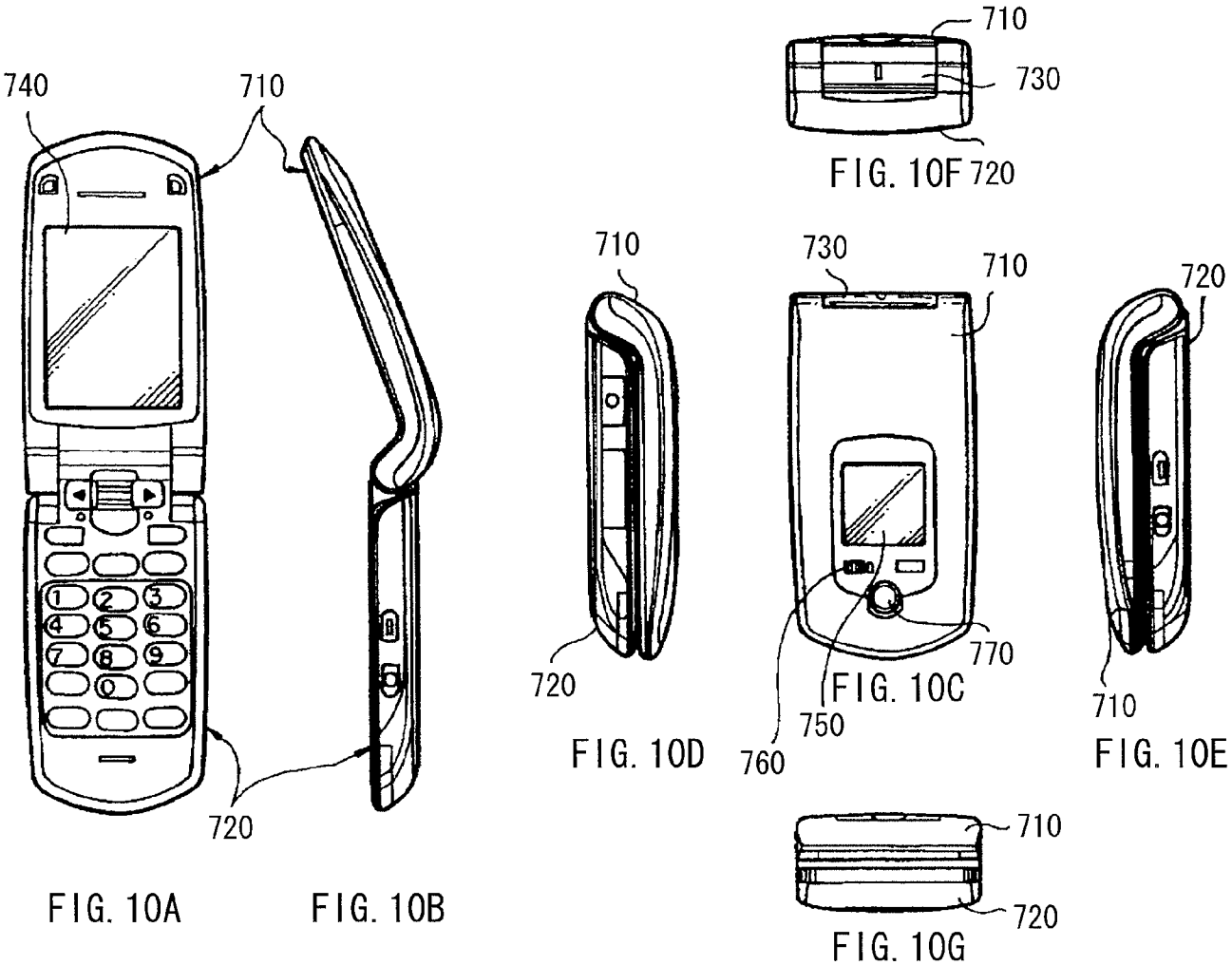
FIG. 10A is an elevation view of a fifth application example unclosed.
FIG. 10B is a side view thereof.
FIG. 10C is an elevation view of the fifth application example closed.
FIG. 10D is a left side view thereof.
FIG. 10E is a right side view thereof.
FIG. 10F is a top view thereof.
FIG. 10G is a bottom view thereof.

FIG. 9 illustrates an appearance of a video camera to which the display unit 1 of the foregoing embodiment is applied. The video camera has, for example, a main body 610, a lens for capturing an object 620 provided on the front side face of the main body 610, a start/stop switch in capturing 630, and a display section 640. The display section 640 is composed of the display unit 1 according to the foregoing embodiment.

Fifth Application Example

FIGS. 10A to 10G illustrate an appearance of a mobile phone to which the display unit 1 of the foregoing embodiment is applied. In the mobile phone, for example, an upper package 710 and a lower package 720 are jointed by a joint section (hinge section) 730. The mobile phone has a display 740, a sub-display 750, a picture light 760, and a camera 770.

The display 740 or the sub-display 750 is composed of the display unit 1 according to the foregoing embodiment.

While the invention has been described with reference to the embodiment and the application examples, the invention is not limited to the foregoing embodiment and the like, and various modifications may be made.

For example, in the foregoing embodiment and the like, the description has been given of the case that the display unit 1 is an active matrix type. However, the structure of the pixel circuit 14 for driving the active matrix is not limited to the case described in the foregoing embodiment and the like, and a capacity device or a transistor may be added to the pixel circuit 14 according to needs. In this case, according to the change of the pixel circuit 14, a necessary drive circuit may be added in addition to the signal line drive circuit 23, the scanning line drive circuit 24, and the power source line drive circuit 25 described above.

Further, in the foregoing embodiment and the like, driving of the signal line drive circuit 23, the scanning line drive circuit 24, and the power source line drive circuit 25 is controlled by the timing control circuit 22. However, other circuit may control driving of the signal line drive circuit 23, the scanning line drive circuit 24, and the power source line drive circuit 25. Further, the signal line drive circuit 23, the scanning line drive circuit 24, and the power source line drive circuit 25 may be controlled by a hardware (circuit) or may be controlled by software (program).

Further, in the foregoing embodiment and the like, the description has been given of the case that the pixel circuit 14 has the 2Tr1C circuit structure. However, as long as a circuit structure in which a transistor is connected to the organic EL device 11 in series is included, a circuit structure other than the 2Tr1C circuit structure may be adopted.

Further, in the foregoing embodiment and the like, the description has been given of the case that the drive transistors $T_{r1}$ and the writing transistor $T_{r2}$ are formed from the n channel MOS type thin film transistor (TFT). However, it is possible that the drive transistors $T_{r1}$ and the writing transistor $T_{r2}$ are formed from a p channel transistor (for example, p channel MOS type TFT). However, in this case, it is preferable that one of the source and the drain of the transistor $T_{r2}$ that is not connected to the power source line PSL and the other end of the retentive capacity $C_s$ are connected to the cathode of the organic EL device 11, and the anode of the organic EL device 11 is connected to the GND or the like.

The present application contains subject matter related to that disclosed in Japanese Priority Patent Application JP 2009-165379 filed in the Japanese Patent Office on Jul. 14, 2009, the entire contents of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A display unit comprising:

a pixel circuit array section that includes a plurality of scanning lines and a plurality of power source lines arranged in rows, a plurality of signal lines arranged in columns, and a plurality of light emitting devices and a plurality of pixel circuits arranged in a matrix corresponding to an intersection of each scanning line and each signal line;

a video signal processing circuit that sets a timing of outputting of an erasing pulse and determines a duty ratio between a light emitting period and a light extinction period, the erasing pulse being output to a signal line based on a video signal;

a signal line drive circuit that applies a fixed voltage to each signal line and applies the fixed voltage to all of the pixel circuits, and subsequently outputs the erasing pulse at the timing set by the video signal processing circuit to a specific signal line;

a power source line drive circuit that concurrently applies a control pulse to all of the power source lines, and concurrently controls light emission and light extinction of all of the light emitting devices; and a scanning line drive circuit that applies a first selection pulse to all of the scanning lines during a time period when the fixed voltage is applied, and subsequently applies a second selection pulse to the plurality of scanning lines during a time period when the erasing pulse is applied, wherein, a voltage value of the erasing pulse is less than a voltage value of the fixed voltage, and a voltage value of the second selection pulse is different than a voltage value of the first selection pulse.

2. The display unit according to claim 1, wherein a magnitude of the voltage value of the second selection pulse is less than that of the first selection pulse.

3. A method of driving a display unit comprising:

a step of preparing a display unit that includes a pixel circuit array section including a plurality of scanning lines and a plurality of power source lines arranged in rows, a plurality of signal lines arranged in columns, and a plurality of light emitting devices and a plurality of pixel circuits arranged in a matrix corresponding to an intersection of each scanning line and each signal line and a drive circuit that drives the pixel circuit array section;

a step of setting a timing of outputting of an erasing pulse and determining a duty ratio between a light emitting period and a light extinction period, the erasing pulse being output to a signal line based on a video signal;

a step of applying a fixed voltage to each signal line and applying the fixed voltage to all of the pixel circuits, and subsequently outputting the erasing pulse at the timing set by a video signal processing circuit to a specific signal line;

a step of concurrently applying a control pulse to all of the power source lines, and concurrently controlling light emission and light extinction of all of the light emitting devices; and a step of applying a first selection pulse to all of the scanning lines during a time period when the fixed voltage is applied, and subsequently applying a second selection pulse to the plurality of scanning lines during a time period when the erasing pulse is applied, wherein, a voltage value of the erasing pulse is less than a voltage value of the fixed voltage, and a voltage value of the second selection pulse is different than a voltage value of the first selection pulse.

4. An electronics device comprising:

a display unit, wherein the display unit has a video signal processing circuit that sets a timing of outputting of an erasing pulse and determines a duty ratio between a light emitting period and a light extinction period, the erasing pulse being output to a signal line based on a video signal, a signal line drive circuit that applies a fixed voltage to each signal line and applies the fixed voltage to all of the pixel circuits, and subsequently outputs the erasing pulse at the timing set by the video signal processing circuit to a specific signal line, a power source line drive circuit that concurrently applies a control pulse to all of the power source lines, and concurrently controls light emission and light extinction of all of the light emitting devices, and a scanning line drive circuit that applies a first selection pulse to all of the scanning lines during a time period when the fixed voltage is applied, and subsequently and sequentially applies a second selection pulse to the plurality of scanning lines during a time period when the erasing pulse is applied, wherein, a voltage value of the erasing pulse is less than a voltage value of the fixed voltage, and a voltage value of the second selection pulse is different than a voltage value of the first selection pulse.

* * * * *